US005564724A

United States Patent [19]

Huang

[11] Patent Number: 5,564,724

[45] Date of Patent: Oct. 15, 1996

[54] HEIGHT ADJUSTABLE BABY WALKER WITH A BASE ATTACHED POSITIONING DEVICE

[76] Inventor: Li-chu C. Huang, No. 9, Alley 2, Lane 606, Sec. 2, Po Ai Rd., Chia Yi City, Taiwan

[21] Appl. No.: 504,255

[22] Filed: Jul. 19, 1995

[51] Int. Cl.[6] ..... B62B 7/06; A47D 13/04

[52] U.S. Cl. ..... 280/87.051; 280/764.1; 280/87.05; 108/120; 297/6; 482/68

[58] Field of Search ..... 280/30, 87.05, 280/87.051, 649, 764.1; 108/117, 118, 119, 120, 146; 297/5, 6, 16.1, 56; 482/66, 68

[56] References Cited

U.S. PATENT DOCUMENTS

| | | | |
|---|---|---|---|
| 4,359,242 | 11/1982 | Gerken et al. | 297/5 |
| 4,576,392 | 3/1986 | Quinlan, Jr. | 280/87.051 |
| 4,759,541 | 7/1988 | Chen | 482/68 |
| 4,799,700 | 1/1989 | Knordler et al. | 280/87.051 |
| 5,324,064 | 6/1994 | Sumser et al. | 280/87.051 X |
| 5,351,978 | 10/1994 | Chen | 280/87.051 |
| 5,447,319 | 9/1995 | Huang | 280/87.051 |
| 5,462,300 | 10/1995 | Chien | 280/87.051 |

FOREIGN PATENT DOCUMENTS

| | | | |
|---|---|---|---|
| 2200054 | 7/1988 | United Kingdom | 297/5 |

*Primary Examiner*—Brian L. Johnson
*Attorney, Agent, or Firm*—Holland & Hart LLP

[57] ABSTRACT

A positioning device for a baby walker includes two linking rods each rotatably mounted on a base portion of the baby walker. Two pairs of legs, each pair is fixedly mounted around first and second ends of a corresponding one of the two linking rods to rotate therewith. Two lug portions each are formed on one end portion of a corresponding one of two opposite sides of the base portion. Two adjusting knobs each have an insert rotatably received in a corresponding one of the two lug portions. A cavity is defined in the insert for fixedly receiving the second end of a corresponding one of the linking rods therein such that the adjusting knob, the linking rod and the associated two legs are rotated in concert with each other.

2 Claims, 12 Drawing Sheets

HEIGHT ADJUSTABLE BABY WALKER WITH A BASE ATTACHED POSITIONING DEVICE

BACKGROUND OF THE INVENTION

1. Field of Invention

The present invention relates to a baby walker.

2. Related Prior Art

Conventional baby walkers have a complex structure and are not easily operated.

The present invention has arisen to mitigate and/or obviate the disadvantages of the conventional baby walker.

SUMMARY OF THE INVENTION

The primary objective of the present invention is to provide a baby walker with an adjustment device and a positioning device.

In accordance with one aspect of the present invention, there is provided a positioning device for a baby walker which comprises a base portion having a passage vertically defined therein and including two opposite sides each having a first end portion and a second end portion. The positioning device comprises two linking rods each rotatably mounted on a corresponding one of the two opposite sides of the base portion and each having a first end and a second end. There are two pairs of legs, each pair fixedly mounted around the first and second ends of a corresponding one of the two linking rods to rotate therewith.

Two lug portions each are formed on the second end portion of a corresponding one of the two opposite sides of the base portion. A bore is defined in each of the two lug portions. Two arcuate flanges each are formed on a periphery of each of the two lug portions and each have a first end and a second end. A groove is defined in each of the arcuate flanges between the first and second ends thereof.

Two first spaces each are respectively defined in the first end of each of the two arcuate flanges and two second spaces each are respectively defined in the second end of each of the two arcuate flanges. The first and second spaces each communicate with the associated groove and each have a dimension smaller than that of the associated groove.

Two adjusting knobs each are rotatably mounted on a corresponding one of the two lug portions and each have an insert rotatably received in the associated bore. A cavity is defined in each of the inserts for fixedly receiving the second end of a corresponding one of the linking rods therein such that each of the two adjusting knobs, the associated linking rod and the associated two legs are rotated in concert with each other.

Two bosses each are formed on each of the two adjusting knobs and each are slidable in a corresponding one of the two grooves of the associated lug portion such that each of the adjusting knobs is movable between a first position where each of the two bosses thereof is snapped in a corresponding one of the two first spaces while each of the associated two legs are disposed at an upstanding status and a second position where each of the two bosses thereof is snapped in a corresponding one of the two second spaces while each of the associated two legs are disposed at horizontal status.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
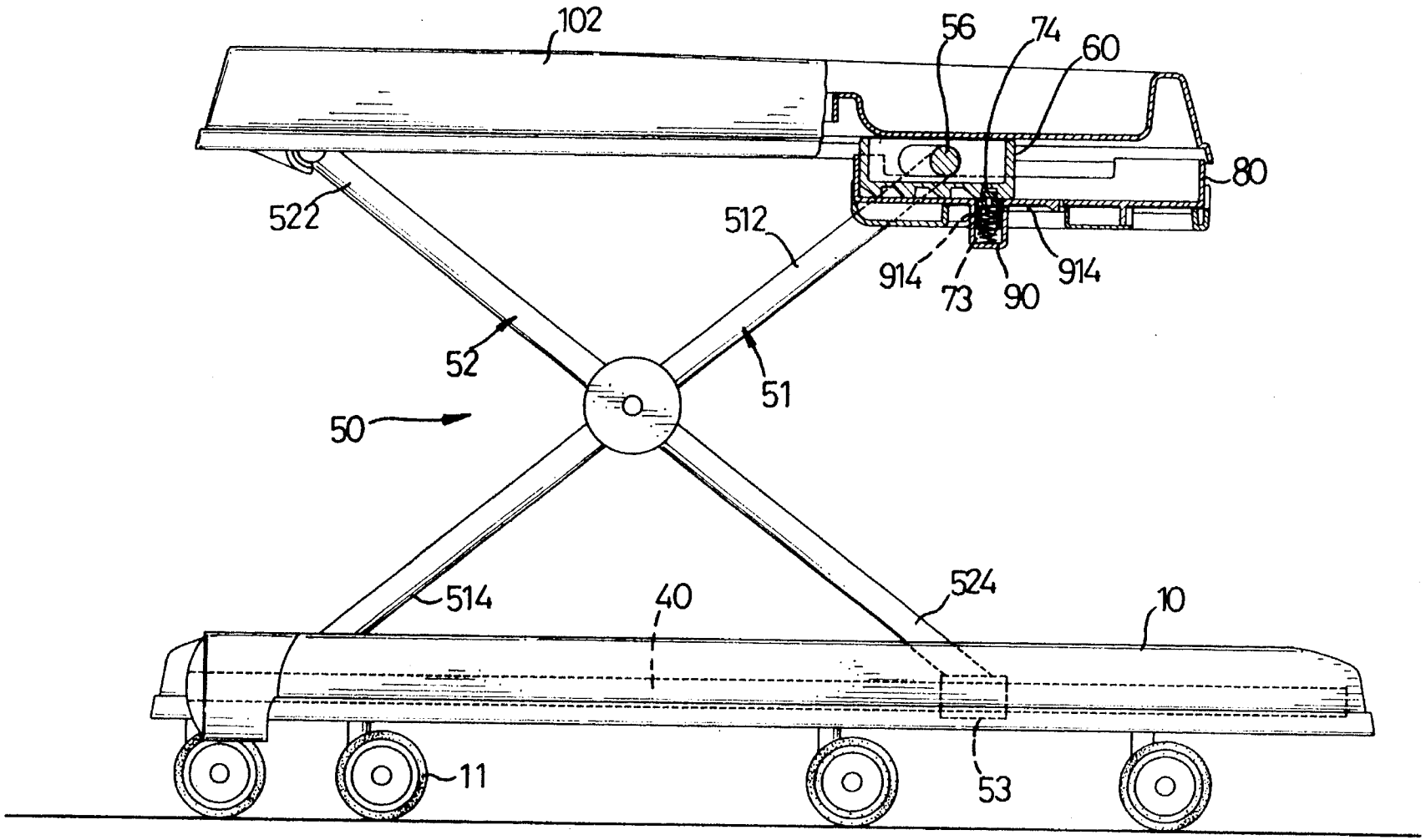
FIG. 1 is a front partially cross-sectional view of a baby walker in accordance with the present invention.
Figure 2:
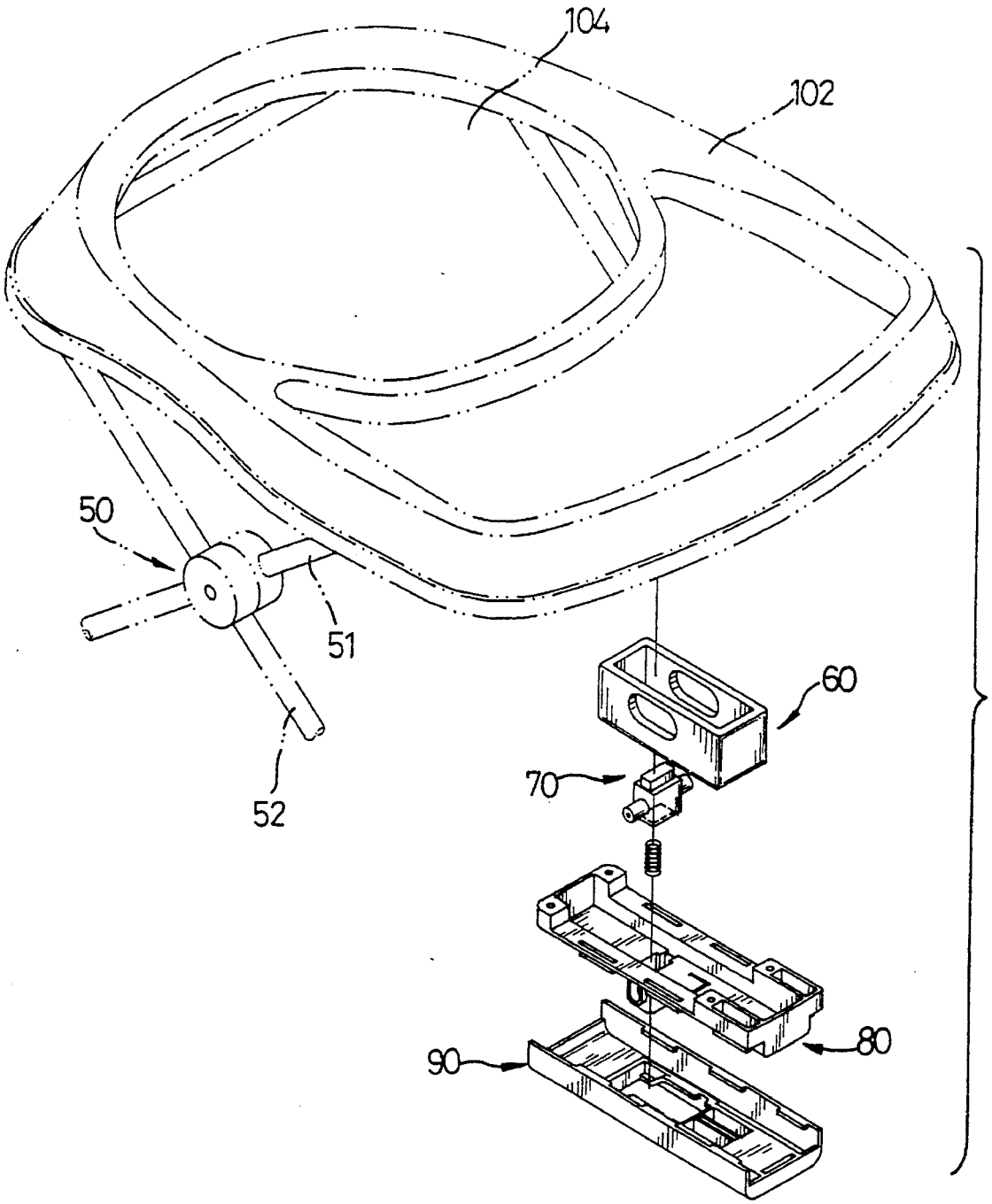
FIG. 2 is a partially exploded view of FIG. 1.

Referring to the drawings and initially to FIGS. 1 and 2, a baby walker in accordance with the present invention comprises a base portion 10 having a first passage 106 (see FIG. 9) vertically defined therein and including two opposite sides each having a first end portion and a second end portion. An upper plate 102 is mounted above the base portion 10 and has a second passage 104 vertically defined therein and includes two opposite sides each having a first end portion and a second end portion.

Two pivot mechanisms 50 each are pivotally mounted between the base portion 10 and the upper plate 102 and each include a first pivot rod 51 and a second pivot rod 52 pivotally engaged with each other. Each of the first pivot rods 51 has a first end 512 and a second end 514 pivotally engaged with the upper plate 102 and the base portion 10 respectively. Each of the second pivot rods 52 has a first end 522 and a second end 524 pivotally engaged with the upper plate 102 and the base portion 10 respectively. A plurality of wheels 11 are rotatably mounted on an underside of the base portion 10.

Figure 3:
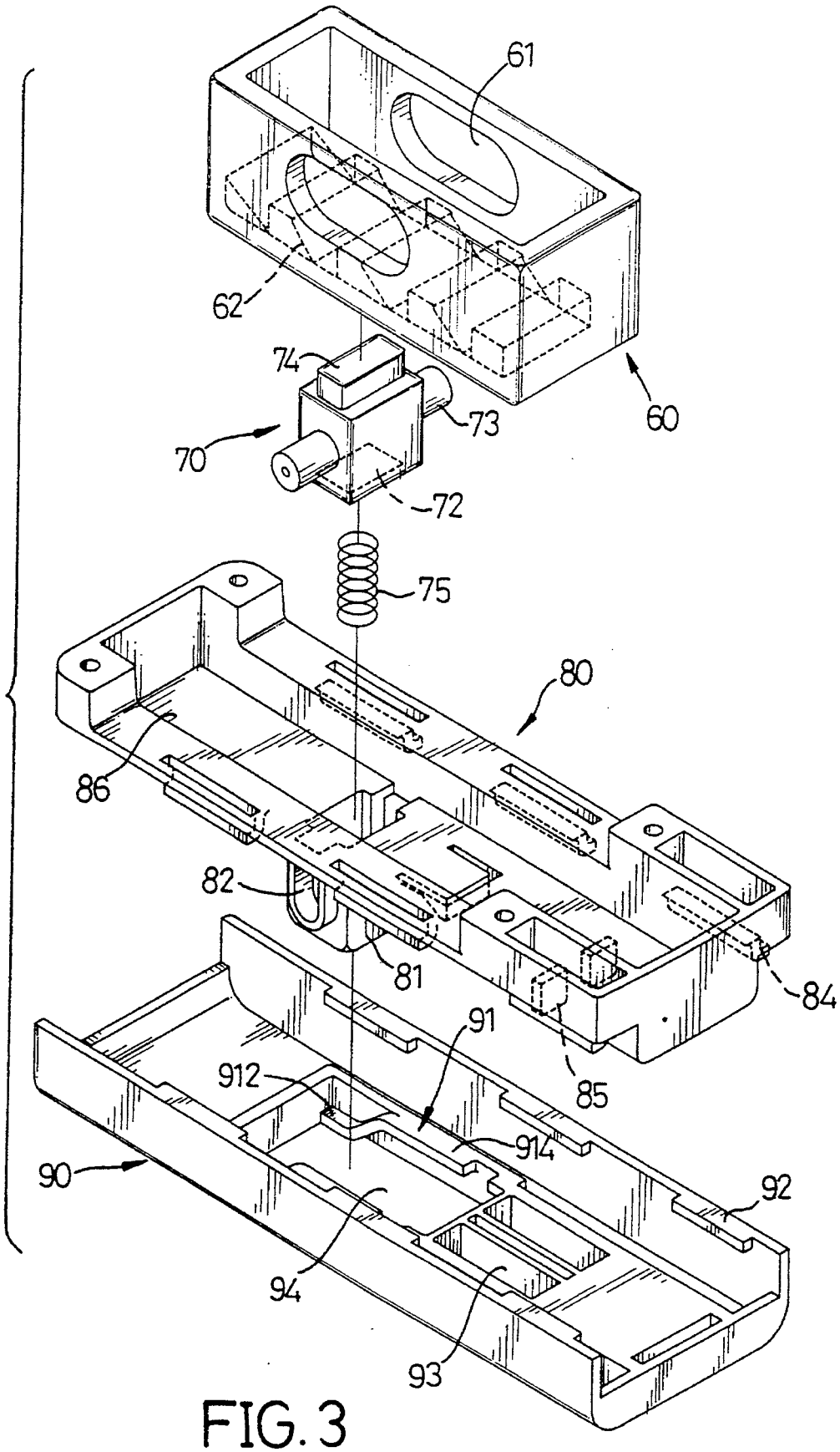
FIG. 3 is an exploded view of an adjustment device as shown in FIG. 2.
Figure 4:
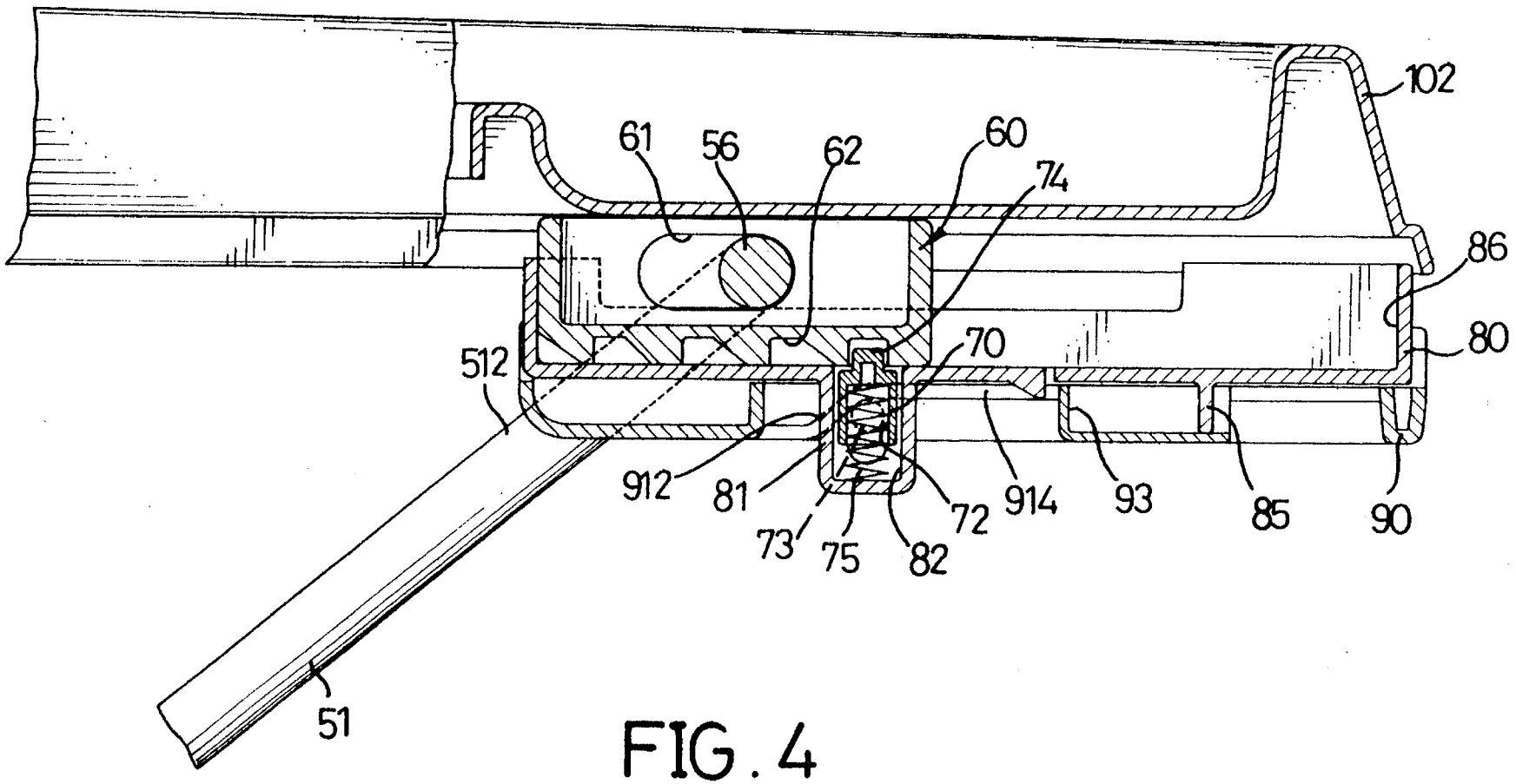
FIG. 4 is a cross-sectional assembly view of FIG. 3.
Figure 5:
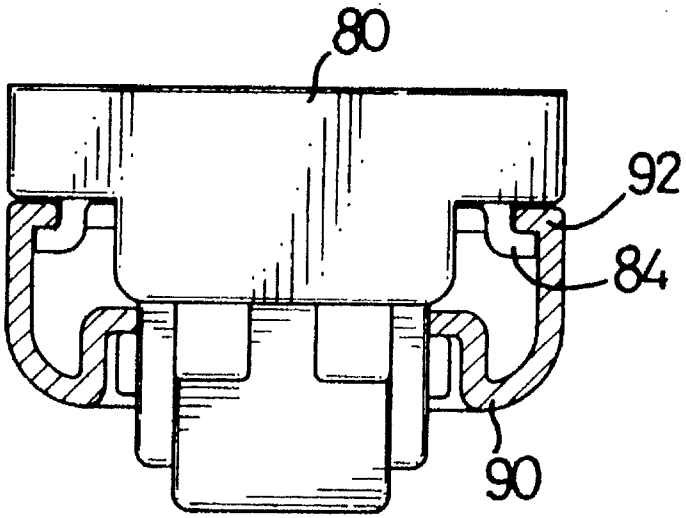
FIG. 5 is a side cross-sectional view of FIG. 3.

Referring to FIGS. 3–5 with reference to FIGS. 1 and 2, two adjustment devices each are mounted on the first end portion of a corresponding one of the two opposite sides of the upper plate 102 and each comprise a positioning member 80 fixedly mounted on an underside of the upper plate 102 and having an elongated track 86 defined therein. An ear 81 is formed on an underside of the positioning member 80 and extends downwardly therefrom. A compartment 82 is laterally defined through the ear 81 and communicates with the elongated track 86. A plurality of elongated flanges 84 substantially L-shaped in section are formed along a periphery of the positioning member 80.

A stop block 70 is movably mounted in the compartment 82. A protrusion 74 is formed on a top portion of the stop block 70. A control rod 73 is fixedly mounted on the stop block 70 and has two distal ends each extending outwards of the compartment 82. An opening 72 is defined in an underside of the stop block 70 and communicates with the compartment 82. A spring 75 is received in the opening 72 and is urged between the stop block 70 and the ear 81.

A movable member 60 is mounted on the positioning member 80 and is horizontally slidable in the elongated track 86 thereof. A plurality of recesses 62 each are defined in an underside of the movable member 60 for releasably receiving the protrusion 74 therein. Two elongated slots 61 are laterally defined in the movable member 60. A movable rod 56 is retained in the elongated slots 61 and has two distal ends each pivotally engaged with the first end 512 of a corresponding one of the first pivot rods 51.

A control member 90 is slidably mounted on the positioning member 80 and abuts on the control rod 73 for moving the stop block 70 upwardly and downwardly such that the protrusion 74 is detachably received in one of the recesses 62. A plurality of flanges 92 each are formed along a periphery of the control member 90 and each are engaged with a corresponding one of the flanges 84 as shown in FIG. 5. An opening 94 is defined in an underside of the control member 90 and communicates with the compartment 82.

Two urging members 91 each are formed on the underside of the control member 90 located in the opening 94 and each have a lower flat end 912 and an upper flat end 914. Two elongated slots 93 are defined in the control member 90 for slidably receiving two blocks 85 therein which are formed on the positioning member 80, thereby facilitating the control member 90 to slide relative to the positioning member 80 horizontally.

Figure 6:
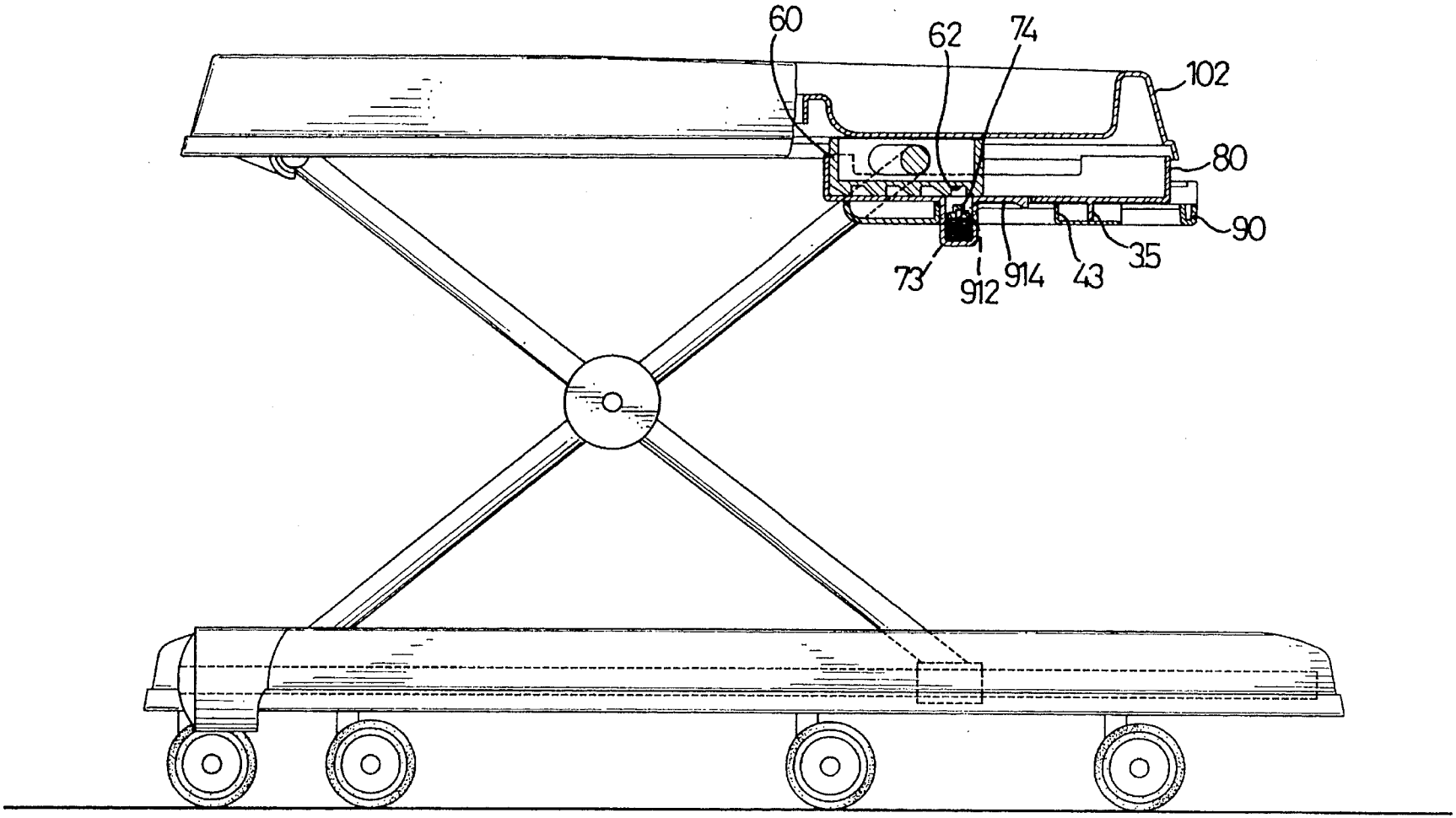
FIG. 6 is an operational view of FIG. 1.
Figure 7:
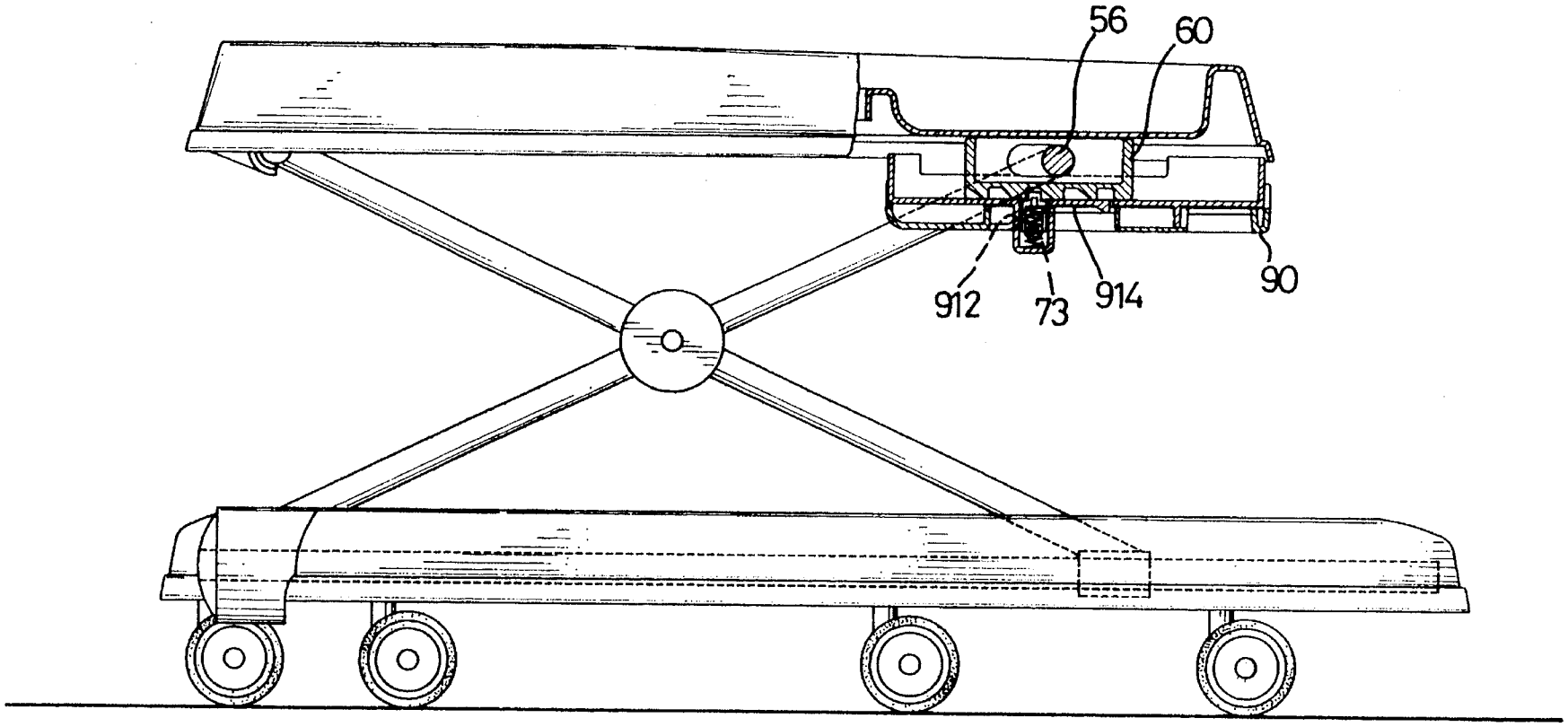
FIG. 7 is an operational view of FIG. 6.

In operation, referring to FIGS. 1, 4, 6 and 7, each of the two distal ends of the control rod 73 is initially rested on an underside of the upper flat end 914 of a corresponding one of the two urging member 91 as shown in FIGS. 1 and 4. The control member 90 is then moved horizontally relative to the positioning member 80 such that the lower flat ends 912 are able to urge the two distal ends of the control rod 73 together with the protrusion 74 downwardly, thereby releasing the protrusion 74 from the associated recess 62 as shown in FIG. 6 such that the movable member 60 is able to be displaced from the position as shown in FIG. 6 to a position as shown in FIG. 7.

The control member 60 is then released such that the stop block 70 is urged upwardly by means of a returning force of the spring 75, thereby pushing the protrusion 74 to be received in another recess 62 so as to stop further movement of the movable member 60. By such an arrangement, a relative distance between the upper plate 102 and the base portion 10 is adjustable.

Figure 8:
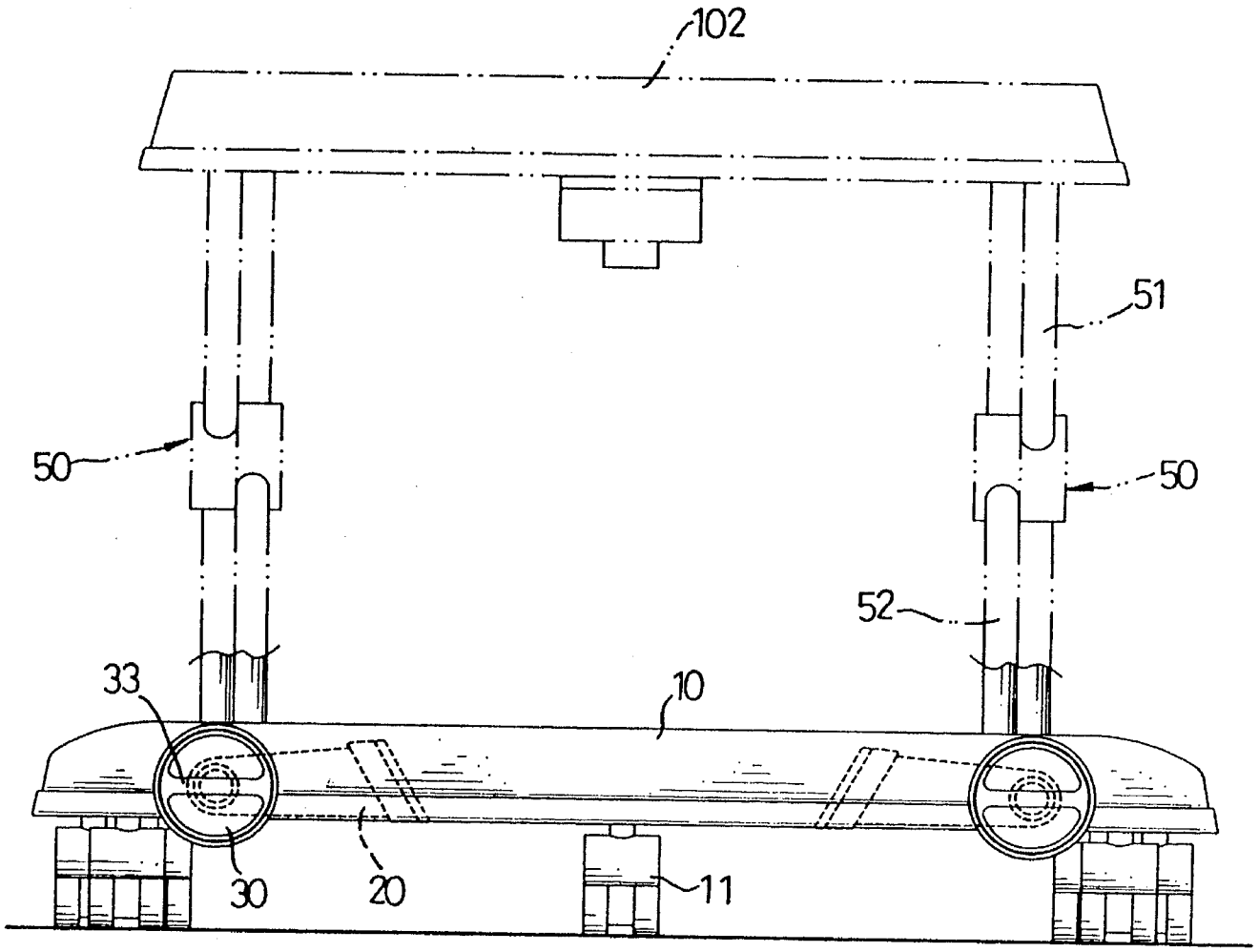
FIG. 8 is a left side view of the baby walker.
Figure 9:
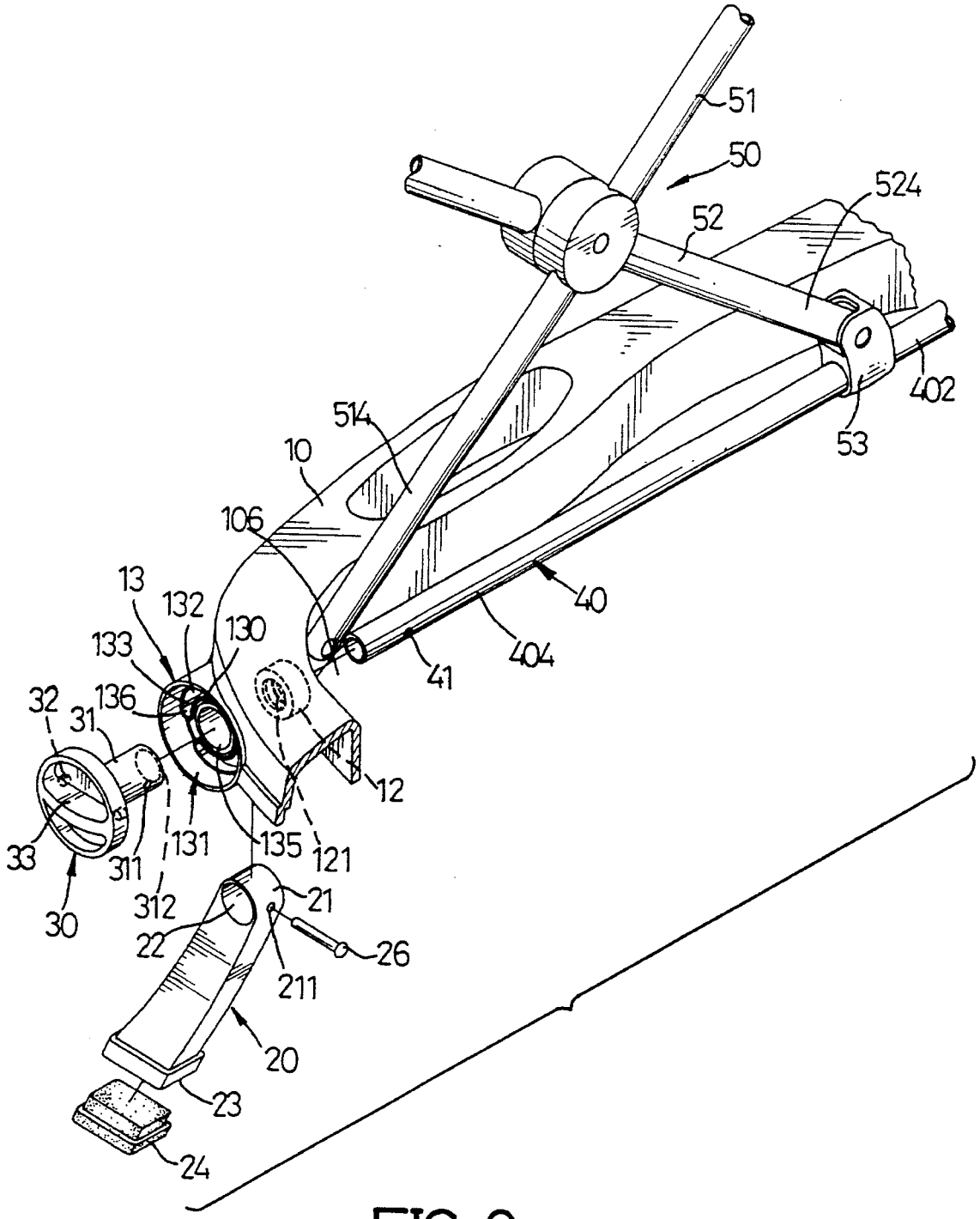
FIG. 9 is a partially exploded view of a positioning device.
Figure 10:
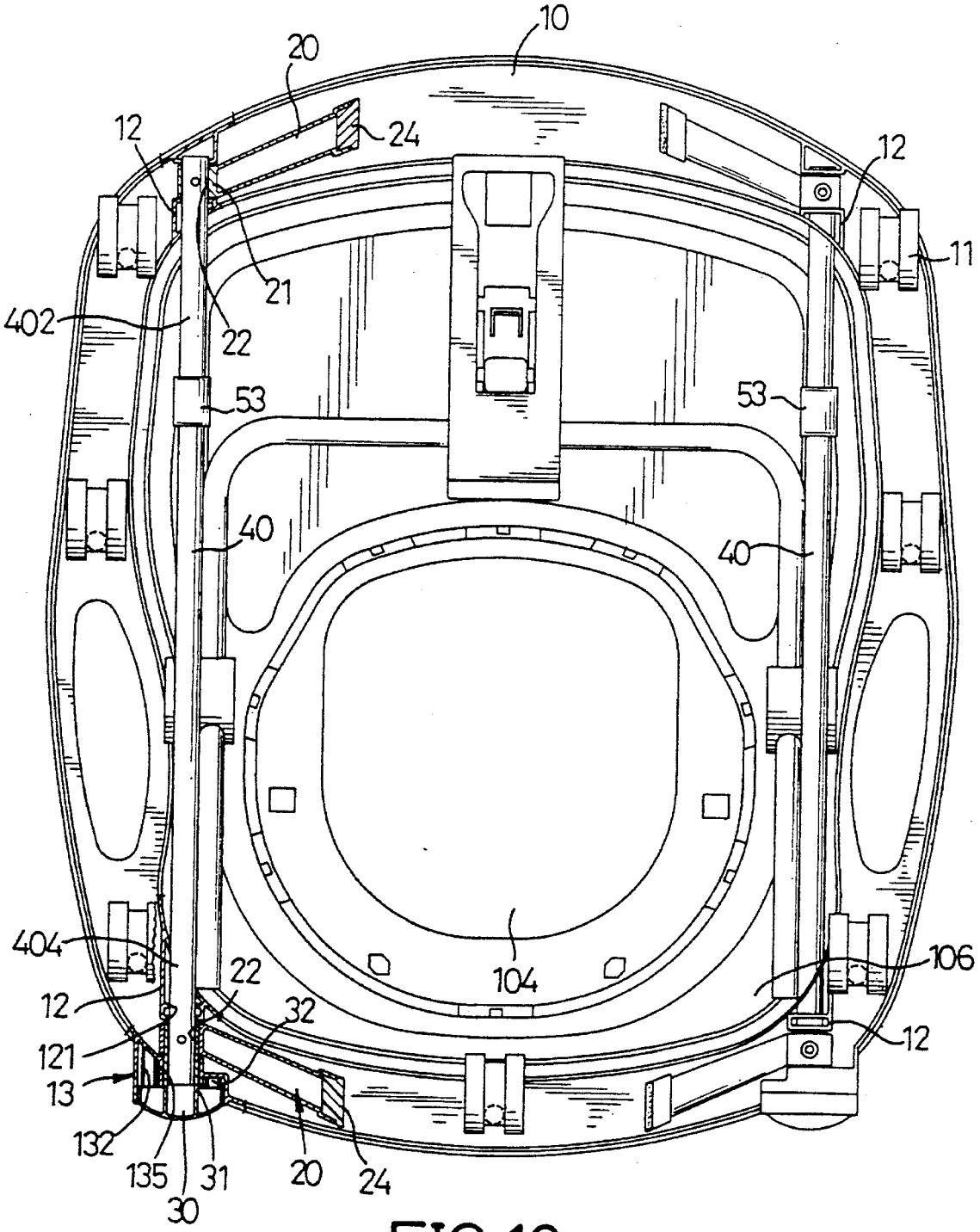
FIG. 10 is a bottom plan partially cross-sectional view of FIG. 8.

Referring to FIGS. 8–10, the baby walker further comprises two positioning devices each mounted on the base portion 10 and each comprising a linking rod 40 rotatably mounted on a corresponding one of the two opposite sides of the base portion 10 and having a first end 402 and a second end 404 which is pivotally engaged with the second end 514 of a corresponding one of the first pivot axles 51. A sleeve 53 is slidably mounted on the first end 402 of each of the linking rods 40 and is pivotally engaged with the second end 524 of a corresponding one of the second pivot axles 52.

Two pairs of legs 20, each pair is fixedly mounted around the first and second ends 402 and 404 of a corresponding one of the two linking rods 40 respectively to rotate therewith.

Figure 11:
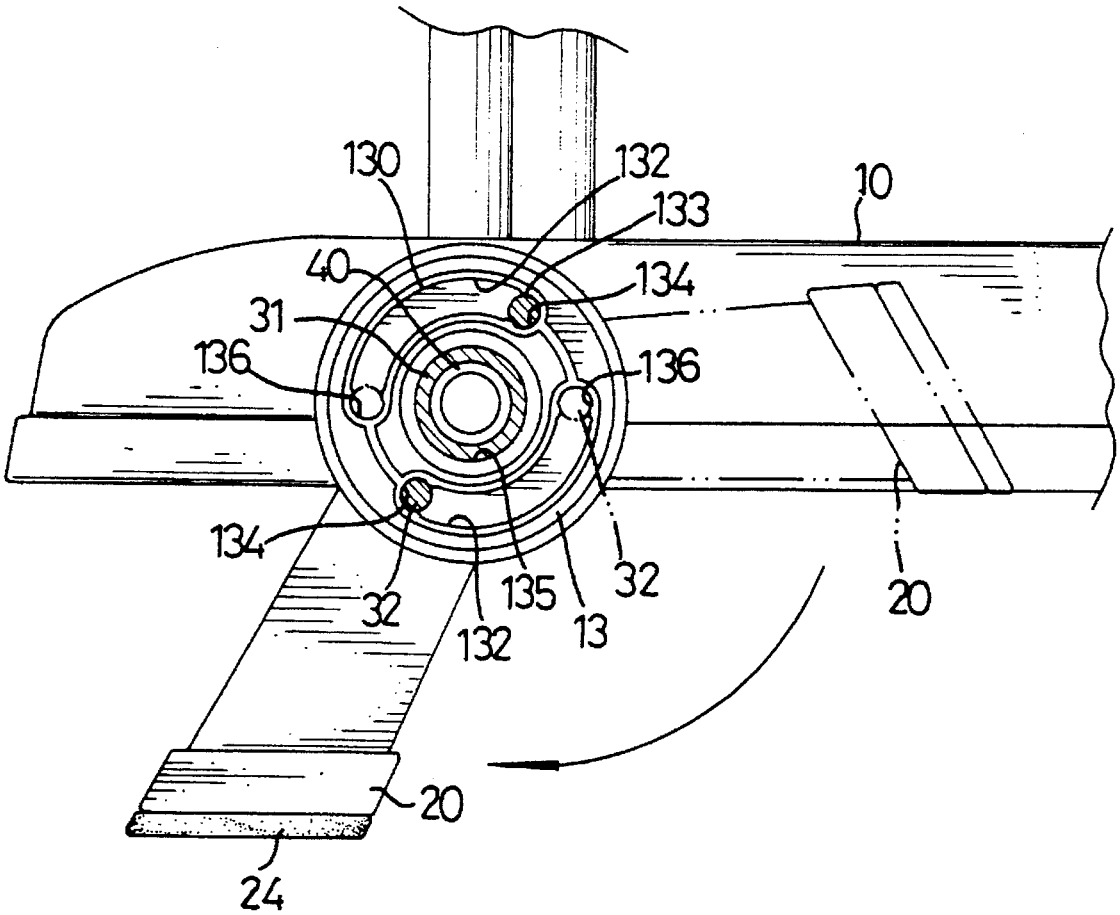
FIG. 11 is a cross-sectional assembly view of FIG. 9.

Referring to FIGS. 9–11, two lug portions 13 each are formed on the second end portion of a corresponding one of the two opposite sides of the base portion 10. A bore 135 is defined in each of the two lug portions 13. Two arcuate flanges 130 each are formed on a periphery of each of the two lug portions 13 and each having a first end and a second end. A groove 132 is defined in each of the arcuate flanges 130 between the first and second ends thereof.

A first space 134 is defined in the first end of each of the two arcuate flanges 130 and a second space 136 is defined in the second end of each of the two arcuate flanges 130. The first and second spaces 134 and 136 each communicates with the associated groove 132 and each have a dimension smaller than that of the associated groove 132. A plurality of projections 133 each are respectively formed between the first space 134 and the associated groove 132 and between the second space 136 and the associated groove 132.

Two adjusting knobs 30 each are rotatably mounted in a corresponding operating opening 131 defined in each of the lug portions 13 and each have an insert 31 rotatably received in the associated bore 135. An elongated lug 33 is formed on each of the two adjusting knobs 30. A cavity 312 is defined in the insert 31 for fixedly receiving the second end 404 of a corresponding one of the linking rods 40 therein such that each of the adjusting knobs 30, the associated linking rod 40 and the associated two legs 20, are rotated in concert with each other.

Two bosses 32 each are formed on each of the two adjusting knobs 30 and each are slidable in a corresponding one of the two grooves 132 of the associated lug portions 13 such that each of the adjusting knobs 30 is movable between a first position where each of the two bosses 32 thereof is snapped in a corresponding one of the two first spaces 134 while each of the legs 20 are disposed at an upstanding status as shown in FIG. 11 in solid lines and a second position where each of the two bosses 32 thereof is snapped in a corresponding one of the two second spaces 136 while each of the legs 20 are disposed at a horizontal status as shown in phantom lines in FIG. 11.

Preferably, each of the adjusting knobs 30 is mounted around the second end 404 of the associated linking rod 40 with the insert 31 thereof received in a hole 22 defined in an upper portion 21 of the associated leg 20 which has an opening 23 defined therein for receiving a pad 24 therein. Two pins 26 each extend through a bore 211 laterally defined in a corresponding leg 21, a bore 311 laterally defined in the associated insert 31 and a bore 41 laterally in the second end 404 of the associated linking rod 40 such that the leg 40 together with the linking rod 40 is rotated in concert with the adjusting knob 30.

Four pairs of positioning rings 12, each pair is respectively formed on the first and second end portions of a corresponding one of the two opposite sides of the base portion 10 and each have a hole 121 defined therein for receiving and retaining the first and second ends 402 and 404 of the associated linking rod 40 therein.

Figure 12:
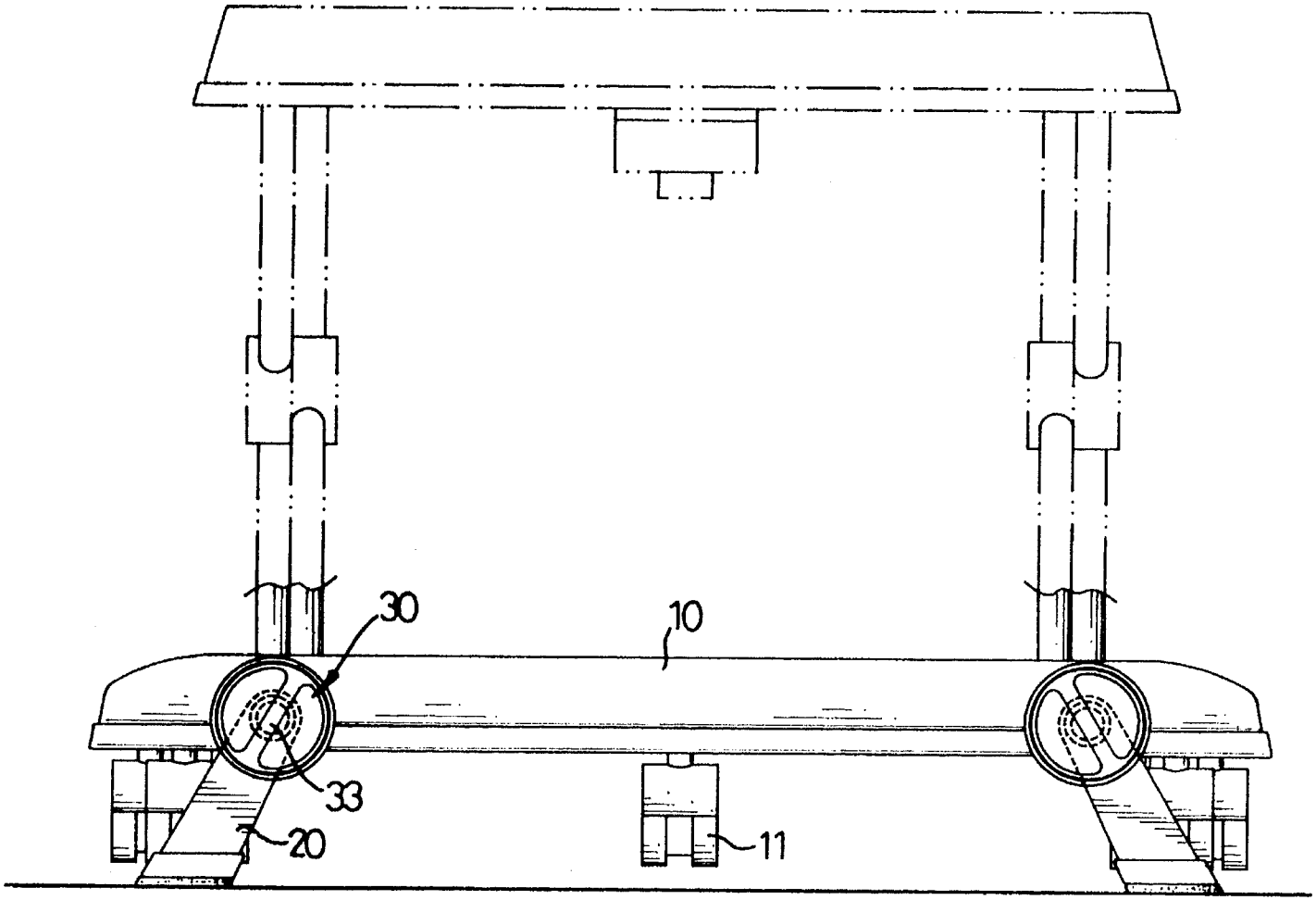
FIG. 12 is an operational view of FIG. 8.

In operation, referring to FIGS. 8 and 11–12, each of the adjusting knobs 30 is initially located at the second position thereof such that each of the four legs 20 is disposed at a horizontal (or folded) status as shown in FIG. 8. When each of the adjusting knobs 30 is rotated to the first position thereof, the four legs 20 are rotated therewith to be disposed at an upstanding (or expanding) status in a tilt manner as shown in FIG. 12 such that each of the wheels 11 are suspended above the ground.

It should be clear to those skilled in the art that further embodiments of the present invention may be made without departing from the teachings of the present invention.

What is claimed is:

1. A baby walker comprising:

a base portion (10) having a first passage (106) vertically defined therein and including two opposite sides each having a first end portion and a second end portion;

an upper plate (102) mounted above said base portion (10) and having a second passage (104) vertically defined therein and including two opposite sides each having a first end portion and a second end portion;

two pivot mechanisms (50) each mounted between said base portion (10) and said upper plate (102) and each including a first pivot rod (51) and a second pivot rod (52) pivotally engaged with each other, each of said first pivot rods (51) having a first end (512) and a second end (514) pivotally engaged with said upper plate (102) and said base portion (10) respectively, each of said second pivot rods (52) having a first end (522) and a second end (524) pivotally engaged with said upper plate (102) and said base portion (10) respectively;

a plurality of wheels (11) rotatably mounted on an underside of said base portion (10);

two adjustment devices each mounted on the first end portion of a corresponding one of the two opposite sides of said upper plate (102) and each comprising:

a positioning member (80) securely mounted on an underside of said upper plate (102) and having an elongated track (86) defined therein, an ear (81) formed on an underside of said positioning member (80) and extending downwardly therefrom, a compartment (82) defined through said ear (81) and communicating with said elongated track (86);

a stop block (70) movably mounted in said compartment (82), a protrusion (74) formed on a top portion of said stop block (70), a control rod (73) fixedly mounted on said stop block (70) and having two distal ends each extending outwards of said compartment (82), an opening (72) defined in an underside of said stop block (70) and communicating with said compartment (82), a biasing member (75) received in said opening (72) and urged between said stop block (70) and said ear (81);

a movable member (60) mounted on said positioning member (80) and horizontally slidable in said elongated track (86), a plurality of recesses (62) each defined in an underside of said movable member (60) for releasably receiving said protrusion (74) therein, an elongated slot (61) laterally defined in said movable member (60), a movable rod (56) having two distal ends each pivotally engaged with the first end (512) of a corresponding one of said first pivot rods (51) and retained in said elongated slot (61); and a control member (90) slidably mounted on said positioning member (80) and abutting on said control rod (73) for moving said stop block (70) vertically such that said protrusion (74) is detachably received in one of said recesses (62);

two positioning devices each mounted on said base portion (10) and each comprising:

a linking rod (40) rotatably mounted on a corresponding one of the two opposite sides of said base portion (10) and having a first end (402) and a second end (404) pivotally engaged with the second end (514) of a corresponding one of said first pivot rods (51), a sleeve (53) slidably mounted on the first end (402) of said linking rod (40) and pivotally engaged with the second end (524) of a corresponding one of said second pivot rods (52);

two legs (20) each fixedly mounted around the first and second ends (402) and (404) of said linking rod (40) to rotate therewith;

a lug portion (13) formed on the second end portion of a corresponding one of the two opposite sides of said base portion (10), a bore (135) defined in said lug portion (13); and an adjusting knob (30) rotatably mounted on said lug portion (13) and having an insert (31) rotatably received in said bore (135), a cavity (312) defined in said insert (31) for fixedly receiving the second end (404) of said linking rod (40) therein such that said adjusting knob (30), said linking rod (40) and said two legs (20) are rotated in concert with each other.

2. A positioning device for a baby walker which comprises a base portion (10) having a passage (106) vertically defined therein and including two opposite sides each having a first end portion and a second end portion, said positioning device comprising:

two linking rods (40) each rotatably mounted on a corresponding one of the two opposite sides of said base portion (10) and each having a first end (402) and a second end (404);

Two pairs of legs (20) each pair fixedly mounted around the first and second ends (402) and (404) of a corresponding one of said two linking rods (40) to rotate therewith;

two lug portions (13) each formed on the second end portion of a corresponding one of the two opposite sides of said base portion (10), a bore (135) defined in each of said two lug portions (13), two arcuate flanges (130) each formed on a periphery of each of said two lug portions (13) and each having a first end and a second end, a groove (132) defined in each of said arcuate flanges (130) between the first and second ends thereof, a first space (134) defined in the first end of each of said two arcuate flanges (130) and a second space (136) defined in the second end of each of said two arcuate flanges (130), said first and second spaces (134) and (136) each communicating with associated said groove (132) and each having a dimension smaller than that of associated said groove (132); and two adjusting knobs (30) each rotatably mounted on a corresponding one of said lug portions (13) and each having an insert (31) rotatably received in associated said bore (135), a cavity (312) defined in said insert (31) for fixedly receiving the second end (404) of a corresponding one of said linking rods (40) therein such that said adjusting knob (30), said linking rod (40) and said two legs (20) are rotated in concert with each other, two bosses (32) each formed on each of said two adjusting knobs (30) and each slidable in a corresponding one of said two grooves (132) of associated said lug portion (13) such that each of said adjusting knobs (30) is movable between a first position where each of said two bosses (32) thereof is snapped in a corresponding one of said two first spaces (134) while each of the legs (20) is disposed at an upstanding status and a second position where each of said two bosses (32) thereof is snapped in a corresponding one of said two second spaces (136) while each of the legs (20) is disposed at a horizontal status.

* * * * *